United States Patent [19]

Acker

[11] Patent Number: 4,637,762

[45] Date of Patent: Jan. 20, 1987

[54] HAND-OPERATED VALVE REFACER

[75] Inventor: Franklin L. Acker, Owosso, Mich.

[73] Assignee: Neway Manufacturing, Inc., Corunna, Mich.

[21] Appl. No.: 856,849

[22] Filed: Apr. 21, 1986

Related U.S. Application Data

[63] Continuation of Ser. No. 793,495, Oct. 30, 1985, which is a continuation of Ser. No. 608,068, May 8, 1984, abandoned.

[51] Int. Cl.[4] ..... B24B 19/26

[52] U.S. Cl. ..... 408/203.5; 30/276; 51/241 VS; 408/207; 408/211

[58] Field of Search ..... 36/276; 408/211, 213, 408/231, 233, 277; 51/241 VS; 29/157.1 R, 157.1 A

[56] References Cited

U.S. PATENT DOCUMENTS

| | | | |
|---|---|---|---|
| 1,124,885 | 1/1915 | Gesswein | 51/241 VS |
| 1,235,959 | 8/1917 | Bradfield . | |
| 1,450,116 | 3/1923 | Ruhlandt . | |
| 1,604,966 | 11/1926 | Brooks et al. . | |
| 1,830,179 | 11/1931 | Stowell . | |
| 1,884,460 | 10/1932 | Williams . | |
| 3,354,528 | 11/1967 | Appleby . | |

FOREIGN PATENT DOCUMENTS

| | | |
|---|---|---|
| 155047 | 9/1951 | Australia . |
| 91999 | 12/1982 | Australia . |
| G8230294.4 | 3/1983 | Fed. Rep. of Germany . |

OTHER PUBLICATIONS

Zim Manufacturing Company Service Tools brochure (Catalog No. AT-19), (cover and p. 15).

*Primary Examiner*—Douglas D. Watts

*Attorney, Agent, or Firm*—Flynn, Thiel, Boutell & Tanis

[57] ABSTRACT

A valve refacing tool having a housing with a bore therethrough which includes a large-diameter portion at one end thereof. A substantially cylindrical support is disposed within the large-diameter portion of the bore and is removably fixed to the housing, as by a plurality of screws extending radially therebetween. This cylindrical support has a small-diameter cylindrical opening which extends axially from the inner end thereof, and which communicates with the small-diameter end of a truncated conical recess which opens outwardly through the other axial end thereof. This conical recess accommodates the head of a poppet valve. A plurality of cutting blades are secured in angularly spaced relationship around the conical recess. The cylindrical support is split into a plurality of separable arcuate sectors, and each is individually fixedly but releasably secured to the housing. The cylindrical support defines a conical recess having a first angle suitable for refacing valve seats of that angle, but the cylindrical support can be replaced by a second cylindrical support having a different conical angle for refacing valve seats having this latter angle.

11 Claims, 5 Drawing Figures

HAND-OPERATED VALVE REFACER

This application is a continuation of application Ser. No. 793,495, filed Oct. 30, 1985, which in turn is a continuation of Ser. No. 608,068, filed May 8, 1984, now abandoned.

FIELD OF THE INVENTION

This invention relates to a tool for refacing of valves and, more particularly, to a tool for resurfacing the annular seating surface on poppet valves of the type used in internal combustion engines.

BACKGROUND OF THE INVENTION

The resurfacing of the seating surface on poppet valves for internal combustion engines has typically required utilization of cumbersome and expensive machinery which effects a grinding of the seating surface by means of a grinding wheel. Such machinery is not only expensive to purchase and maintain, but it is also complex to operate. Small repair shops generally can not afford such machinery, and hence will often replace the valve due to an inability to efficiently refinish the seating surface on the old valve.

In an attempt to provide an improved tool for refacing of poppet valves, there has been suggested a valve refacing device employing a cylindrical sleevelike housing having a conical recess formed in one or both ends thereof. This valve refinishing device, as disclosed by Australian Application No. 91999/82, employs one or more carbide cutting blades which are positioned within elongated bores formed in the housing and thence project forwardly through elongated slots so that the cutting blades project outwardly from the conical surface defining the conical recess. With this device, the poppet valve is positioned so that the stem projects coaxially through a clearance opening provided in the housing, whereupon the truncated conical seating surface is positioned within the recess for engagement with the cutting blades. Relative rotation between the device and the poppet effects a cutting, and hence a refacing, of the seating surface. In one embodiment of this device, the recesses at opposite ends of the housing are of different angles to accommodate valves of two different sizes. In another embodiment, a conical shell is positionable within the conical recess, which shell captivates the blades, and the shell is held within the recess by an end cap which threadedly surrounds the housing.

While the valve refacing device of Australian Application No. 91999/82 does perform a desirable valve refacing operation, nevertheless this device does possess disadvantages. For example, the manner in which the blades are mounted on or within the housing, using either the grooved housing or the separate conical shell for confining the blades, substantially increases the complexity of the overall device and, particularly with the embodiment utilizing bores for confining the blades, makes the housing difficult and complex to machine. These arrangements also make it difficult to provide a conical recess having a minimal diameter opening at the apex end of the recess, and hence make it difficult to position the cutting blades close to the small-diameter end of the recess, whereby refacing of very small-diameter poppet valves is difficult.

Another valve refacing device has also been suggested by German Gebrauchsmuster No. G 82 30 294.4 which illustrates a device having a one-piece sleevelike housing provided with a conical recess in one end thereof, which recess has grooves extending radially along the wall thereof, and carbide cutting blades are positionable within these grooves. With this arrangement, the machining of the housing and the forming of the conical recess and blade grooves prevents the recess from being of small diameter at the apex end, and hence prevents the blades from being positioned close to the apex, whereby this device is unable to accommodate small-diameter poppet valves.

In addition, while the device of the aforementioned Australian application does disclose an embodiment having recesses at opposite ends of different angles, nevertheless this device is able to successfully accommodate only two different sizes of poppet valves, and the unit of the aforementioned German Gebrauchsmuster can accommodate only a single size (i.e., single angle) poppet valve. Thus, none of the devices discussed above have the capability of being readily adapted so as to permit utilization with poppet valves having any angle on the seating surface.

Accordingly, it is an object of this invention to provide an improved valve refacing tool of the aforementioned type, which refacing tool is structurally and functionally more advantageous than the tools described above.

In the valve refacing tool of this invention, there is provided a sleevelike housing having an enlarged cylindrical opening formed in one end thereof, which cylindrical opening terminates at its inner end in a shoulder. A sleevelike cylindrical support is removably positionable within the cylindrical opening and is securable to the housing, as by screws. This cylindrical support has a conical recess formed in the outer axial end thereof, which conical recess at its apex end communicates with a small-diameter opening which extends axially through the support and communicates with the opening which extends coaxially of the housing. This conical recess is bounded by a conical surface having a plurality of grooves formed therein and projecting radially outwardly thereof. These grooves permit carbide cutting blades to be locked in position therein. The cylindrical support is axially split so as to be defined by a plurality, preferably at least three, of arcuate sectors. This enables the central opening of the cylindrical support to be of minimal diameter, which diameter is sized so as to normally be only slightly larger than the typical valve stem and is hence a small fraction of the diameter of the conical surface at its outer or large-diameter end, whereby this permits the conical surface to be properly machined so that the apex end communicates with said opening of minimal diameter. This also enables the blade-receiving grooves to project radially to the apex end of the conical recess, and the blades themselves can be positioned close to the apex so as to readily accommodate poppet valves of small diameter. A set containing several sectored cylindrical supports is provided for association with the housing, and each one of the supports has a conical recess defined by a different included angle. The cylindrical supports can be readily interchanged to permit the valve refacing unit to be utilized with poppet valves of different angles.

The improved valve refacing tool of this invention, as briefly described above, is highly desirable since it is of a small and compact structure, it can be readily manually manipulated when refinishing of a valve seat is desired, it can be efficiently manufactured and assembled, and it provides maximum flexibility and usability due to its capability of refinishing valve seats having a wide range of diameters and angles.

Other objects and purposes of the invention will be apparent to persons familiar with tools of this general type upon reading the following specification and inspecting the accompanying drawings.

Figure 1:
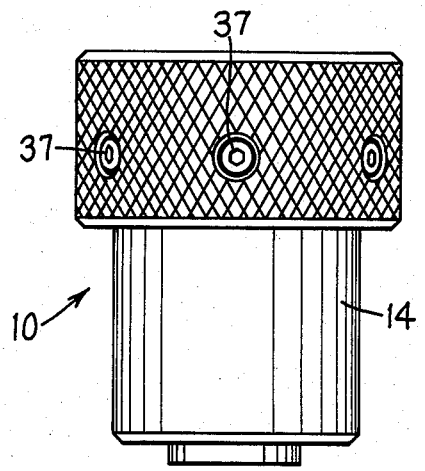
FIG. 1 is an elevational view of the improved valve refacing tool of this invention.

Certain terminology will be used in the following description for convenience in reference only, and will not be limiting. For example, the words "upwardly", "downwardly", "leftwardly" and "rightwardly" will refer to directions in the drawings to which reference is made. The words "inwardly" and "outwardly" will refer to directions toward and away from, respectively, the geometric center of the tool and designated parts thereof. Said terminology will include the words specifically mentioned, derivatives thereof, and words of similar import.

DETAILED DESCRIPTION

Referring to the drawings, there is illustrated a valve refinishing tool 10 according to the present invention. This tool is designed specifically for use with a poppet-type valve 11. Such poppet valve has a truncated conical valve surface 12 formed on the head thereof, which head is secured to one end of an elongated stem 13. This valve surface 12 conventionally extends at an angle of either 30° or 45° relative to a plane which is perpendicular to the longitudinal axis of the valve stem, although other angles are also utilized.

The tool 10 includes a housing 14 formed substantially as a cylindrical sleeve having an externally stepped configuration. This housing 14 has a stepped bore 16 extending coaxially therethrough. This bore 16 includes a lower bore 17 which is of smallest diameter, an intermediate bore 18 of intermediate diameter, and an upper bore 19 of largest diameter.

The lower end of housing 14 has a liner sleeve 21 fixedly positioned within the lower bore 7, such as by being press fit therein. This liner sleeve 21 in turn has a sleevelike bushing 22 snugly but removably positioned therein, which bushing 22 defines therethrough a bore 23 which is coaxially aligned with the bore through the housing so as to snugly accommodate the valve stem 13. The sleevelike bushing 22 has a shouldered flange 24 which abuts against the lower axial end of the housing, which shoulder flange enables the bushing 22 to be removed and replaced by a like bushing having a different diameter opening 23 therethrough, whereupon the bushing 23 is selected according to the diameter of the stem 13 so as to snugly guide this stem during utilization of the tool.

Tool 10 also includes a removable cylindrical support 26 which is adapted to mount thereon appropriate cutting blades, and is positionable within the upper end of the housing 14. This cylindrical support 26 includes an inner cylindrical portion 27 which is sized so as to be snugly but removably positioned within the intermediate bore 18, and an outer cylindrical portion 28 which is sized so as to be removably but snugly positioned within the upper bore 19. The cylindrical support 26, when disposed within the upper end of the stepped bore, abuts against a shoulder 29 defined at the interface between the lower and intermediate bores.

The cylindrical support 26 has a conical bore 31 formed in and opening outwardly through the outer or upper end thereof, which conical bore at its apex or small-diameter end coaxially communicates with a small-diameter cylindrical bore 32 which extends axially downwardly through the remainder of the cylindrical support 26. This bore 31 and its cylindrical opening 32 extends coaxially through the cyindrical support 26 and coaxially communicates with the lower bore portion 17.

The cylindrical support 26 is axially split so as to define a plurality of arcuate sectors or segments, there being three such segments 33, 33' and 33" in the preferred embodiment. These segments are formed by means of radial cuts 34 which project inwardly from the periphery of the cylindrical support to the longitudinal axis.

Each of the segments 33, 33', 33" is individually fixedly secured to the housing 14. For this purpose, each segment is secured by a pair of screws 37 which are spaced circumferentially and extend through appropriately shouldered openings 16 formed in the housing 14 for threaded engagement with aligned threaded openings formed in the appropriate segment.

The conical wall 31 has a plurality, here three, of elongated slots or grooves 41 formed therein, there being one said groove 41 formed in each of the segments in the illustrated embodiment. These grooves 41 have their inner ends in communication with the opening 32, from which the grooves project radially outwardly along the conical wall 31 so that the outer ends project through the outer or upper axial end of the respective segment. An elongated cutting element 42, such as an elongated cutting bar of carbide material having cutting teeth 43 extending in angled relationship across the upper surface thereof, is releasably positioned within each of the grooves 41. This cutting element 42, in the illustrated embodiment, has a trapezoidal cross section so that the base width exceeds the top width, and the groove 41 has a similar trapezoidal cross section so that the cutting element 42 hence has to be slidably inserted into the groove from the outer end thereof. A small counterbore 44 is formed in the conical surface 31 directly adjacent each of the grooves 41, and an annular wedge 46 is positionable within each counterbore and has an appropriate side surface which wedgingly contacts one of the tapered side surfaces on the respective cutting element 42. A screw 47 appropriately secures the wedge 46 downwardly so as to securely hold the cutting element 42 within its groove. As so positioned, the cutting element 41 projects upwardly above the conical surface 31 so as to expose the teeth 43 to permit performance of a refacing operation.

The three cutting blades 42 are preferably disposed in a nonuniform angularly spaced relationship such that the angles between adjacent blades are not all equal.

Figure 3:
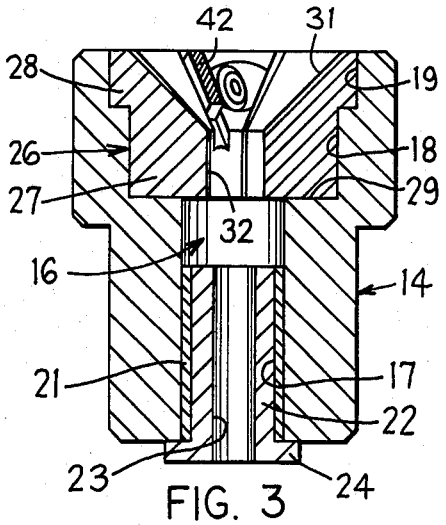
FIG. 3 is a central sectional view taken substantially along line III—III in FIG. 2.
Figure 2:
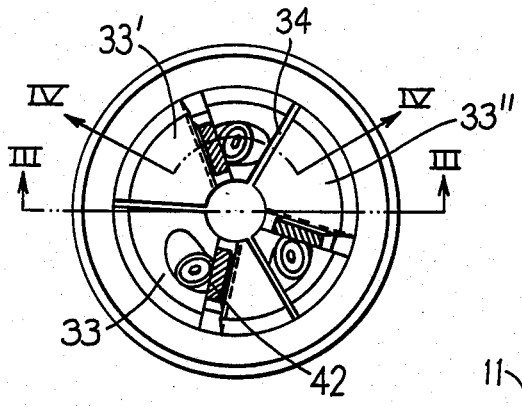
FIG. 2 is a top view of the device shown in FIG. 1.
Figure 4:
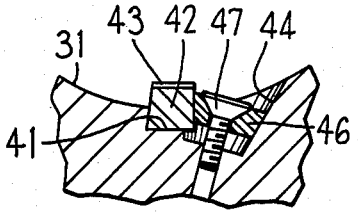
FIG. 4 is an enlarged, fragmentary sectional view taken substantially along line IV—IV in FIG. 2.

The conical surface 31 associated with the embodiment illustrated by FIG. 3 is designed for accommodating a poppet valve having a 45° angle valve seat. This 45° angle is measured relative to a plane which extends perpendicular with respect to the longitudinal axis of the valve stem. However, the removable cylindrical support 26 of FIG. 3 can be replaced by the modified cylindrical support 126 of FIG. 5, which support has a conical surface 131 designed for accommodating a valve seat having an angle of 30°. This modified cylindrical support 126 is identical to the support 26, and is again formed from three sectors, although the conical surface 131 in this case extends at an angle of 30° relative to a plane perpendicular to the longitudinal axis of the valve stem.

Hence, in the valve refacing tool 10 according to the present invention, the tool includes not only the housing 14, but also includes at least two removable cylindrical supports 26 and 126, each of which is preferably defined by three arcuate sectors, with one of the supports being suitable for a 30° valve seat and the other suitable for a 45° valve seat. Further cylindrical supports having different angles thereon can also be provided if desired. The cylindrical supports 26 and 126 can hence be readily interchanged depending upon the angle of the valve seat which is to be refaced. The interchange of the cylindrical supports can be easily accomplished merely by removing the six screws 37, removing the one cylindrical support from the housing, positioning the other support within the housing, and thereafter securing the latter to the housing by means of the six screws 37.

Figure 5:
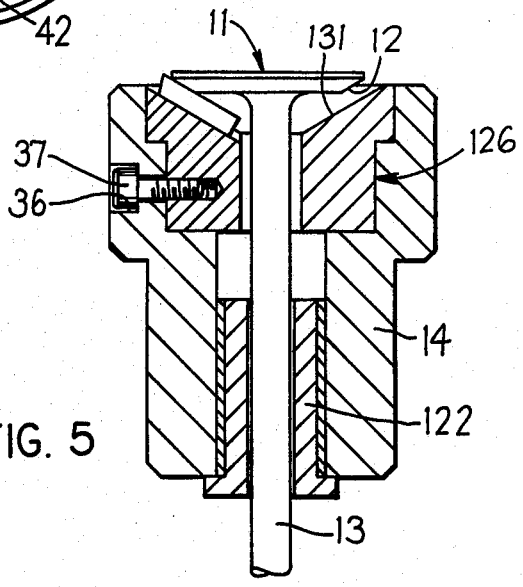
FIG. 5 is as view similar to FIG. 3 but illustrating the tool having a different support therein for accommodating a valve of a different angle.

By use of this set of removable cylindrical supports, the overall tool can be readily adapted to accommodate a wide variety of valve seat angles without requiring complex or multiple tool assemblies. At the same time, the segmented construction of the cylindrical support enables the cylindrical opening 32 to be of minimal diameter and permits the conical surface 31 and grooves 41 to be properly machined so as to extend all the way up to this opening 32. In fact, as illustrated by FIGS. 3 and 5, this cylindrical opening 32 is preferably sized so as to be only slightly larger than the diameter of the typical valve stem 13, and hence the opening 32 is generally only slightly larger than the diameter of the bushing bore 23. The blades 42 can thus be positioned so as to readily accommodate and permit resurfacing of valve seats of small diameter.

To utilize the tool, a poppet valve is positioned within the tool substantially as illustrated by FIG. 5, following which relative rotation effects refinishing of the valve seat 12 due to the latter being rotated across the cutting teeth 43 associated with the cutting blades 42. This refacing operation is preferably accomplished manually, such as by securing the free end of the valve stem 13 within a vise so as to stationarily support the valve 11, following which the tool 10 can be manually gripped and axially pulled toward the valve head to control the contact pressure between the cutting blades and the valve seat, whereupon manual rotation of the tool then effects the desired refacing of the valve seat. The refacing can hence be easily manually controlled and accomplished.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A tool for refacing the valve seat of a poppet-type valve having a stem, comprising:

a sleevelike housing having a stepped bore extending axially therethrough, said stepped bore including a large-diameter bore portion which opens outwardly through one axial end of said housing, said large-diameter bore portion defining an inner annular shoulder on said housing, said stepped bore also including a further bore portion which opens through the other end of said housing and coaxially communicates with said large-diameter bore portion;

a substantially cylindrical sleevelike support removably positioned within and substantially wholly occupying said large-diameter bore portion, said cylindrical support having an inner axial surface which substantially abuts said shoulder;

said cylindrical support having opening means extending coaxially therethrough in alignment and communication with said bore, said opening means including a truncated conical recess which opens inwardly from an outer axial end of said cylindrical support and converges as it projects axially therefrom for communication with a small-diameter opening which projects axially of said cylindrical support from an inner axial end thereof, said small-diameter opening having a diameter which only slightly exceeds the diameter of the typical valve stem but is smaller than the diameter of said further bore portion, and said conical recess being defined by a substantially truncated conical surface which opens outwardly of said one axial end;

bushing means stationarily mounted on said housing within said further bore portion, said bushing means having a cylindrical opening of small cross-section extending coaxially therethrough for guiding the elongated valve stem;

at least one elongated cutting blade removably mounted on said cylindrical support, said elongated cutting blade extending substantially radially outwardly along said conical surface and having a cutting surface thereon which is spaced outwardly from said conical surface;

said cylindrical support being axially split so as to define a plurality of separable arcuate sectors which together effectively define a complete sleevelike cylinder; and movable securing means coacting between said housing and each said sector for permitting each said sector to be positioned within said large-diameter bore portion and fixedly but releasably secured to said housing.

2. A tool according to claim 1, wherein said cylindrical support is defined by at least three arcuate sectors each extending through an angle of substantially less than 180°.

3. A tool according to claim 2, wherein said movable securing means includes a plurality of screws which extend radially through said housing for threaded connection with the respective sectors, each said sector being fixedly but removably secured to said housing by at least two said screws which are circumferentially spaced apart.

4. A tool for refacing the valve seat of a poppet-type valve having a stem, comprising:

a sleevelike housing having a stepped bore extending axially therethrough, said stepped bore including a large-diameter bore portion which opens outwardly through one axial end of said housing, said large-diameter bore portion defining an inner annular shoulder on said housing;

a substantially cylindrical sleevelike support removably positioned within and substantially wholly occupying said large-diameter bore portion, said cylindrical support having an inner axial surface which substantially abuts said shoulder;

said cylindrical support having opening means extending coaxially therethrough in alignment and communication with said bore, said opening means including a truncated conical recess which opens inwardly from an outer axial end of said cylindrical support and converges as it projects axially therefrom for communication with a small-diameter opening which projects axially of said cylindrical support from an inner axial end thereof, said small-diameter opening having a diameter which only slightly exceeds the diameter of the typical valve stem, and said conical recess being defined by a substantially truncated conical surface which opens outwardly of said one axial end;

at least one elongated cutting blade removably mounted on said cylindrical support, said elongated cutting blade extending substantially radially outwardly along said conical surface and having a cutting surface thereon which is spaced outwardly from said conical surface;

said cylindrical support being axially split so as to define a plurality of separable arcuate sectors which together effectively define a complete sleevelike cylinder, said cylindrical support being defined by at least three arcuate sectors each extending through an angle of substantially less than 180°;

movable securing means coacting between said housing and each said sector for permitting each said sector to be positioned within said large-diameter bore portion and fixedly but releasably secured to said housing, said movable securing means includes a plurality of screws which extend radially through said housing for threaded connection with the respective sectors, each said sector being fixedly but removably secured to said housing by at least two said screws which are circumferentially spaced apart; and said cylindrical support having three blade-receiving grooves formed in the conical surface thereof in angularly spaced relationship, each of said grooves accommodating one of said blades therein, each said groove having a trapezoidal-shaped cross section and opening outwardly at the opposite ends thereof as defined at the large- and small-diameter ends of the truncated conical surface, said blade having a trapezoidal cross section provided with a base having a width which is greater than the width of the surface having the cutting teeth thereon, said blade being slidably insertable into the groove from one of the ends thereof.

5. A tool according to claim 4, wherein the stepped bore includes a small-diameter bore portion which opens outwardly through the other end of said housing, and a sleevelike bushing snugly but removably positioned within said small-diameter bore portion.

6. A tool according to claim 4, including a second cylindrical support which is removably positionable within said large-diameter bore portion and is substantially identical to said first-mentioned cylindrical support except that the second cylindrical support has a conical recess therein which is of a different angle from the conical recess of the first-mentioned cylindrical support.

7. A tool for refacing the annular valve seat formed on the head of a poppet-type valve having an elongated stem projecting from the valve head, comprising:

a sleevelike and substantially cylindrical housing having a stepped bore extending axially therethrough, said stepped bore including a large-diameter bore portion which opens outwardly through one axially end of said housing, said large-diameter bore portion defining an inner annular shoulder on said housing;

a substantially cylindrical sleevelike support removably positioned within and substantially wholly occupying said large-diameter bore portion, said cylindrical support having an inner axial surface which substantially abuts said shoulder;

said cylindrical support having opening means extending coaxially therethrough in alignment and communication with said bore, said opening means including a truncated conical recess which opens inwardly from an outer axial end of said cylindrical support and converges as it projects axially therefrom for communication with a small-diameter opening which projects axially of said cylindrical support from an inner axial end thereof, said conical recess being defined by substantially truncated conical surface which opens inwardly of said one axial end, and said small-diameter opening having a diameter which is only a small fraction of the diameter of said truncated conical surface at the large diameter end thereof as defined at said outer axial end of said cylindrical support;

said cylindrical support being axially split so as to define at least three separable arcuate sectors each extending through an angle of substantially less than 180°, said sectors together effectively defining a complete sleevelike cylinder when positioned within the large-diameter bore portion of said housing;

movable securing means coacting between said housing and each said sector for permitting each said sector to be positioned within said large-diameter bore portion and fixedly but releasably secured to said housing;

each of said arcuate sectors having at least one blade-receiving groove formed in the conical surface thereof, said groove extending substantially radially of said conical surface so that the groove opens outwardly at the opposite ends thereof through the large- and small-diameter ends of the truncated conical surface; and at least one elongated cutting blade fixedly but removably mounted within at least one of said grooves, said elongated blade extending substantially radially outwardly along said conical surface and having a cutting surface thereon which is spaced outwardly from said conical surface.

8. A tool according to claim 7, wherein said sleevelike housing is substantially of a stepped cylindrical construction and includes a smaller-diameter annular portion integrally joined to a large-diameter annular portion, said large-diameter annular portion being defined at said one axial end of said housing in surrounding relationship to said large-diameter bore portion, said large-diameter annular portion of said housing being externally knurled to permit gripping thereof.

9. A tool for refacing the annular valve seat formed on te head of a poppet-type valve having an elongated stem projecting from the valve head, comprising:

a sleevelike and substantially cylindrical housing having a stepped bore extending axially therethrough, said stepped bore including a large-diameter bore portion which opens outwardly through one axial end of said housing, said large-diameter bore portion defining an inner annular shoulder on said housing, said stepped bore also including a small-diameter bore portion which opens through the other end of said housing and coaxially communicates with said large-diameter bore portion;

a substantially cylindrical sleevelike support removably positioned within and substantially wholly occupying said large-diameter bore portion, said cylindrical support having an inner axial surface which substantially abuts said shoulder;

said cylindrical support having opening means extending coaxially therethrough in alignment and communication with said bore, said opening means including a truncated conical recess which opens inwardly from an outer axial end of said cylindrical support and converges as it projects axially therefrom for communication with a small-diameter opening which projects axially of said cylindrical support from an inner axial end thereof, said conical recess being defined by substantially truncated conical surface which opens inwardly of said one axial end, said small-diameter opening having a diameter which is only a small fraction of the diameter of said truncated conical surface at the large diameter end thereof as defined at said outer axial end of said cylindrical support, and said small-diameter opening as formed in said support being of smaller diameter than said small-diameter bore portion;

said cylindrical support being axially split so as to define at least three separable arcuate sectors each extending through an angle of substantially less than 180°, said sectors together effectively defining a complete sleevelike cylinder when positioned within the large-diameter bore portion of said housing;

movable securing means coacting between said housing and each said sector for permitting each said sector to be positioned within said large-diameter bore portion and fixedly but releasably secured to said housing;

each of said arcuate sectors having at least one blade-receiving groove formed in the conical surface thereof, said groove extending substantially radially of said conical surface so that the groove opens outwardly at the opposite ends thereof through the large- and small-diameter ends of the truncated conical surface; and at least one elongated cutting blade fixedly but removably mounted within at least one of said grooves, said elongated blade extending substantially radially outwardly aong said conical surface and having a cutting surface thereon which is spaced outwardly from said conical surface.

10. A tool according to claim 9, including a sleevelike bushing snugly but removably positioned within said small-diameter bore portion, said bushing having a cylindrical opening of small cross-section extending coaxially therethrough for guiding the elongated valve stem.

11. A tool for refacing the annular valve seat formed on the head of a poppet-type valve having an elongated stem projecting from the valve head, comprising:

a sleevelike and substantially cylindrical housing having a stepped bore extending axially therethrough, said stepped bore including a large-diameter bore portion which opens outwardly through one axial end of said housing, said large-diameter bore portion defining an inner annular shoulder on said housing;

a substantially cylindrical sleevelike support removably positioned within and substantially wholly occupying said large-diameter bore portion, said cylindrical support having an inner axial surface which substantially abuts said shoulder;

said cylindrical support having opening means extending coaxially therethrough in alignment and communication with said bore, said opening means including a truncated conical recess which opens inwardly from an outer axial end of said cylindrical support and converges as it projects axially therefrom for communication with a small-diameter opening which projects axially of said cylindrical support from an inner axial end thereof, said conical recess being defined by substantially truncated conical surface which opens inwardly of said one axial end, and said small-diameter opening having a diameter which is only a small fraction of the diameter of said truncated conical surface at the large diameter end thereof as defined at said outer axial end of said cylindrical support;

said cylindrical support being axially split so as to define at least three separable arcuate sectors each extending through an angle of substantially less than 180°, said sectors together effectively defining a complete sleevelike cylinder when positioned within the large-diameter bore portion of said housing;

movable securing means coacting between said housing and each said sector for permitting each said sector to be positioned within said large-diameter bore portion and fixedly but releasably secured to said housing;

each of said arcuate sectors having at least one blade-receiving groove formed in the conical surface thereof, said groove extending substantially radially of said conical surface so that the groove opens outwardly at the opposite ends thereof through the large- and small-diameter ends of the truncated conical surface; and at least one elongated cutting blade fixedly but removably mounted within the groove of each said sector, said elongated blade extending substantially radially outwardly along said conical surface and having a cutting surface thereon which is spaced outwardly from said conical surface, the blades as mounted on said three arcuate sectors being positioned in a non-uniformly angularly spaced pattern.

* * * * *